US009878871B2

(12) United States Patent
Pollock et al.

(10) Patent No.: US 9,878,871 B2
(45) Date of Patent: Jan. 30, 2018

(54) DYNAMIC GUIDE FOR A PAPER FOLDING MACHINE

(71) Applicant: Goss International Americas, Inc., Durham, NH (US)

(72) Inventors: David Clarke Pollock, Somersworth, NH (US); John James Sposato, Jr., Dover, NH (US); Gerald Roger Douillard, Manchester, NH (US)

(73) Assignee: Goss International Americas, Inc., Durham, NH (US)

( * ) Notice: Subject to any disclaimer, the term of this patent is extended or adjusted under 35 U.S.C. 154(b) by 945 days.

(21) Appl. No.: 14/068,618

(22) Filed: Oct. 31, 2013

(65) Prior Publication Data

US 2014/0187404 A1 Jul. 3, 2014

Related U.S. Application Data

(60) Provisional application No. 61/747,767, filed on Dec. 31, 2012.

(51) Int. Cl.
*B65H 45/04* (2006.01)
*B41F 13/60* (2006.01)
(Continued)

(52) U.S. Cl.
CPC ..... *B65H 45/04* (2013.01); *B41F 13/60* (2013.01); *B41F 13/64* (2013.01); *B65H 45/167* (2013.01)

(58) Field of Classification Search
CPC ..... B65H 45/04; B65H 45/167; B41F 13/64
See application file for complete search history.

(56) References Cited

U.S. PATENT DOCUMENTS 4,697,805 A * 10/1987 Herb ..... B65H 45/168 270/47
5,013,020 A * 5/1991 Stoll ..... B41F 13/54 270/13

(Continued)

FOREIGN PATENT DOCUMENTS

EP 1 840 066 3/2007
JP H10-129929 A 5/1998

*Primary Examiner* — Patrick H Mackey
(74) *Attorney, Agent, or Firm* — Davidson, Davidson & Kappel, LLC; Jennifer L. O'Connell; William C. Gehris

(57) ABSTRACT

A folding device is provided for folding a sheet comprises a jaw cylinder, a folding cylinder, a paper guide, and an actuator. The jaw cylinder has a jaw, and the folding cylinder has a hold down element and a folding blade. The folding blade is movable between an extended position and a retracted position. The folding blade is in the extended positron to transfer one or more sheets to the jaw cylinder during a fold off operation, and the folding blade is in the retracted position during a collect operation. The paper guide is positioned between the folding cylinder and the jaw cylinder. The paper guide includes a static guide element and a reciprocating guide element connected to the static guide element, the reciprocating guide element movable between a retracted position and an extended position. The actuator is connected to the reciprocating guide element; the actuator configured and arranged to place the reciprocating guide element into the extended position during the collect operation and into the retracted position during the fold-off operation.

11 Claims, 8 Drawing Sheets

(51) Int. Cl.
*B41F 13/64* (2006.01)
*B65H 45/16* (2006.01)

(56) References Cited

U.S. PATENT DOCUMENTS 5,226,871 A * 7/1993 Skipor ..... B65H 45/167
270/49
5,547,452 A * 8/1996 Kepert ..... B65H 45/163
493/427
5,807,227 A * 9/1998 Field ..... B65H 29/52
493/357
6,554,266 B2 * 4/2003 Nanba ..... B65H 29/52
270/32
6,605,027 B1 8/2003 Coultier et al.
6,635,005 B1 * 10/2003 Duhamel ..... B65H 45/167
493/417
7,217,233 B2 * 5/2007 Masaki ..... B65H 29/52
493/424
7,377,892 B2 * 5/2008 Camossa ..... B65H 45/167
493/417

* cited by examiner

DYNAMIC GUIDE FOR A PAPER FOLDING MACHINE

This application claims priority to U.S. Provisional Application Ser. No. 61/747,767, filed Dec. 31, 2012, the entire disclosure of which is hereby incorporated by reference.

The present invention relates generally to printing presses and more particularly to folders and guides used with folding cylinders.

BACKGROUND

U.S. Pat. No. 6,605,027 discloses a folder in a signature processing machine. In order to reduce the formation of dog ears and crumpling when the signature tail is ripped away from the transfer cylinder there is provided a fold off guide at the exit side of the nip. The fold off surface of the guide is movably disposed. The fold off guide may be a flexible plate, cam, eccentric or belt arrangement.

U.S. Pat. No. 6,554,266 purportedly discloses a guide plate movable between an active position located within the sheet transfer space and a retreat position where the guide plate does not interfere with the sheet transferring from the collect cylinder to the jaw cylinder.

EP Patent No. 1 840 066 purportedly discloses a retaining element with a folding blade cylinder and a folding jaw cylinder which removes a printed product over a folding flap in a handover section from the folding blade cylinder. The rotating retaining element, which is arranged in the direction of rotation of the folding blade cylinder in the handover section, presses down a printed product edge running over the folding blade cylinder in the direction of the folding blade cylinder.

BRIEF SUMMARY OP THE INVENTION

In accordance with a first embodiment of the present invention, a folding device for folding a sheet comprises a jaw cylinder, a folding cylinder, a paper guide, and an actuator. The jaw cylinder has a jaw, and the folding cylinder has a hold down element and a folding blade. The folding blade is movable between an extended position and a retracted position. The folding blade is in the extended position to transfer one or more sheets to the jaw cylinder during a fold off operation, and the folding blade is in the retracted position during a collect operation. The paper guide is positioned between the folding cylinder and the jaw cylinder. The paper guide includes a static guide element and a reciprocating guide element connected to the static guide element, the reciprocating guide element movable between a retracted position and an extended position. The actuator is connected to the reciprocating guide element; the actuator configured and arranged to place the reciprocating guide element into the extended position during the collect operation and into the retracted position during the fold-off operation.

In accordance with another aspect, of this embodiment, the folding cylinder is rotatable about a first axis, the jaw cylinder is rotatable about a second axis, the first axis being parallel to the second axis.

In accordance with yet another aspect of this embodiment, the jaw cylinder may receive the sheet from the folding cylinder at a folding interface between the folding cylinder and the jaw cylinder.

In accordance with yet another aspect of this embodiment, the static guide element may have a first concave surface located adjacent to a circumferential surface of the folding cylinder, and a second concave surface located adjacent to a circumferential surface of the jaw cylinder. Further, the static guide element may also include a convex surface located between the first and second concave surfaces. Alternatively, or additionally, the reciprocating guide element may include a convex surface located between the first and second concave surfaces of the static guide element.

In accordance with yet another aspect of this embodiment, the reciprocating guide element contacts sheets on the folding cylinder during the collect operation.

In accordance with yet another aspect of this embodiment, the actuator may include a crank, the crank coupled to the reciprocating element via one or more links. Further, the crank may be rotatably secured to the static guide element. A drive and a controller may also be provided, and the controller may control the crank via the drive.

In accordance with yet another aspect of this embodiment, the actuator may instead include a cam and cam follower, the cam follower connected to the reciprocating guide element.

In accordance with a second embodiment of the present invention, a printing press is provided comprising: at least one printing units, a folding device in accordance with the first embodiment, and a controller.

In accordance with a third embodiment of the present invention, a method is provided for folding a sheet with a folding apparatus. The folding apparatus includes a folding cylinder, a jaw cylinder, and a paper guide positioned between the folding cylinder and the jaw cylinder, the paper guide including a static guide element and a reciprocating guide element connected to the static guide element, the reciprocating guide element movable between a retracted position and an extended position. The method comprises gripping a sheet on a folding cylinder; moving the reciprocating guide element into the extended position; transporting the sheet around the folding cylinder for a plurality of revolutions of the folding cylinder; constraining the sheet with a reciprocating paper guide element during the transporting step with the reciprocating guide element in the extended position; moving the reciprocating guide element into the retracted position; folding the sheet off into a jaw cylinder; and constraining the sheet with the static guide element during folding-off.

BRIEF DESCRIPTION OF THE DRAWINGS

A preferred embodiment of the present invention will be elucidated with reference to the drawings, in which.

DETAILED DESCRIPTION OF A PREFERRED EMBODIMENT

The geometries of known folding guides are at best a compromise between the ideal guide form for constraint of the signature during the collect operation versus the fold-off operation. This compromise results in defects in the folded paper products. This disparity between the ideal guide forms for the two phases of operation in the exit area between the cylinders increases with cylinder diameter and operating speed.

When signatures or sheets are collected around a collect cylinder, the first sheet or signature collected at the pin or gripper is transported around the collect cylinder at least one full revolution so subsequent sheets can be collected on top of the first sheet or signature. Known fold off guides do not sufficiently restrain the sheets in the area just past the folding blade and folding jaw interface. The insufficient constraint manifests at higher speeds as defects in the sheets/signatures in the form of dog ears and transverse creases.

Folding guides that project further into the fold-off space may relieve the lack of constraint on the first sheet collected on the first pass, but also have side effects. These guides may cause the leading edge of the collected sheets to accelerate excessively during fold-off. Similar defects may result in the sheets or signature including dog ears and transverse creases.

By combining a stationary guide surface with a reciprocating guide surface, sufficient constraints may be applied to the first or initial sheet or signature collected on a collect cylinder, while reducing existing side effects. The reciprocating guide provides the necessary constraint on the first pass of the first sheet or signature on the collect cylinder but is subsequently concealed within the stationary guide during fold off. As a result, the stationary guide may be optimized for use during folding-off instead of being designed as a compromise between the two phases of collecting sheets on the collect cylinder and folding sheets off the collect cylinder. In another preferred embodiment the stationary and reciprocating guides may be arranged in an inline configuration.

Figure 1:
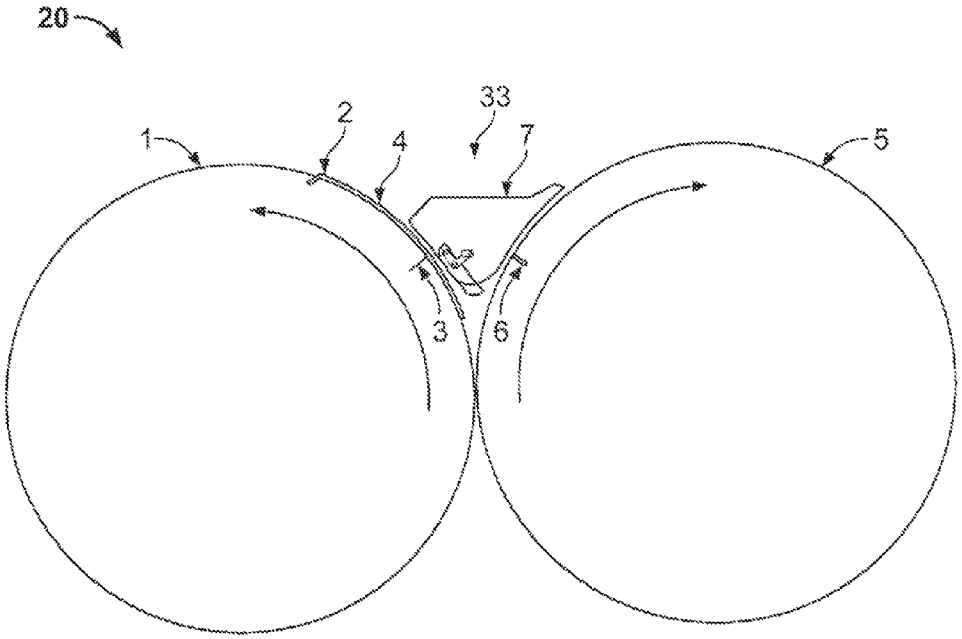
FIG. 1 shows a folding cylinder having a folding guide in accordance with the present invention.
Figure 7:
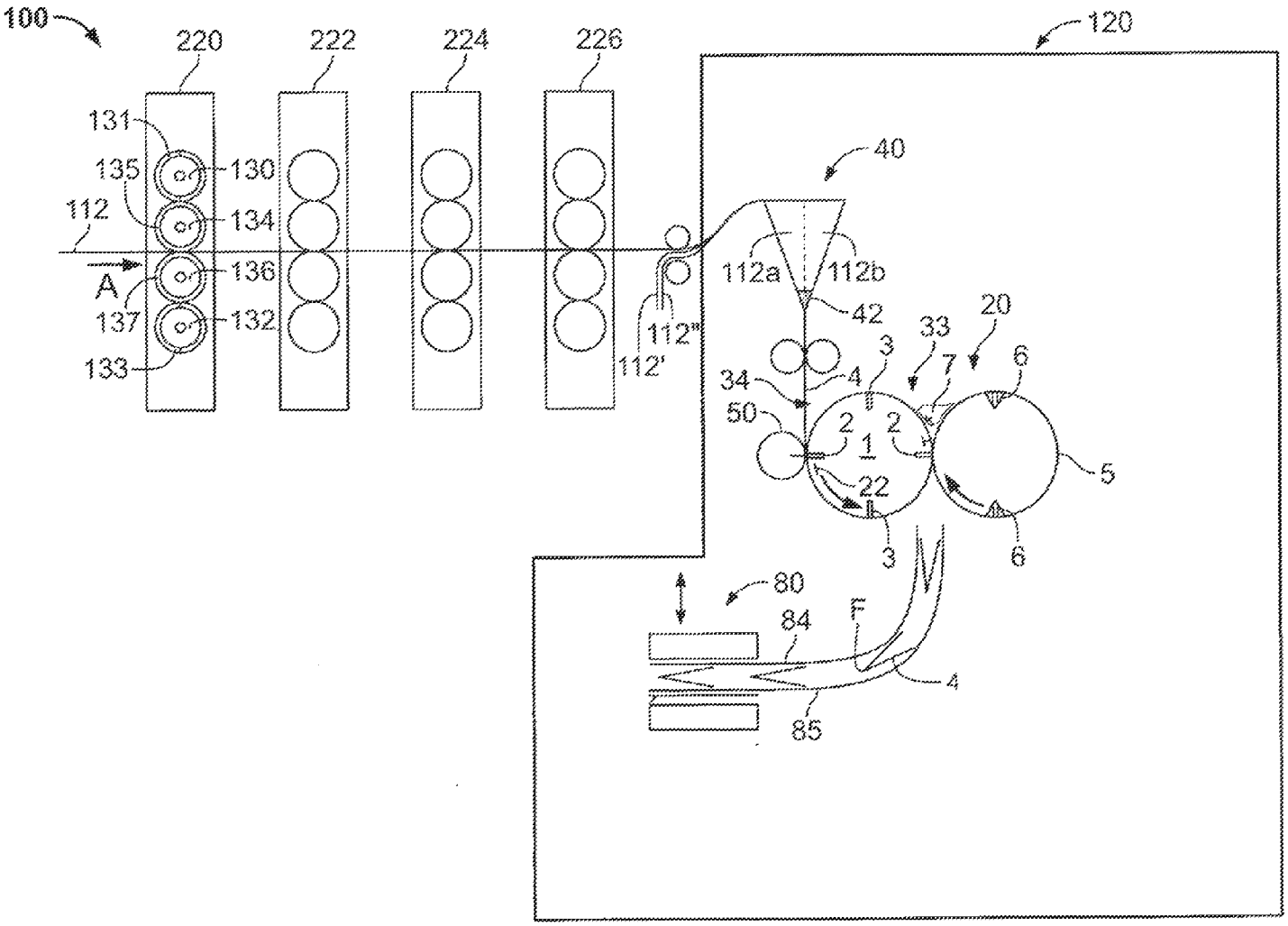
FIG. 7 shows a printing press having the folding guide as shown in FIGS. 1 to 3.

FIG. 1 shows a folding device 20 including a folding cylinder 1 having one or more hold down elements 2 and tucking or folding blades 3. Hold down elements 2 may be pins, grippers or vacuum grippers, for example, or any other type of hold down element known in the art for transporting a sheet or signature around a circumference of folding cylinder 1. Folding cylinder 1 may be a tucking cylinder as known in the art. Hold down elements 2 secure pre-cut paper forms, signatures, sheets or other printed products 4 during an initial phase of the cross-folding operation. Folding cylinder 1 interacts with a second cylinder 5, for example, a jaw cylinder. Jaw cylinder 5 includes at least one jaw 6 for receiving printed products 4 from folding cylinder 1. A paper guide or folding guide 7 is situated at a folding interface 33 between cylinders 1 and 5. Referring to FIG. 7, a web may be cut into printed products 4 by cutting cylinder 50 at an incoming side 34 of the folding cylinder 1, and the printed products 4 are transferred to jaw cylinder 5 at folding interface 33 located at the outgoing side of the folding cylinder 1.

Folding cylinders, jaw cylinder 5 and folding cylinder 1, act together on printed products 4 typically in one of two basic modes, a fold-only mode, also known as straight mode operation, or a gather and fold mode, also known as a collect mode operation. During a typical straight folding operation, each printed product 4 is folded in a fold-off operation the first time the printed product 4 passes between the interface of jaw cylinder 5 and folding cylinder 1. A printed product 4 is gripped by hold down element 2 and transported around the periphery of folding cylinder 1. Folding cylinder 1 and jaw cylinder 5 are timed with one another. Folding blade 3 extends out of folding cylinder 1 thereby pushing printed product 4 into a jaw 6 of jaw cylinder 5 forming a cross fold in printed product 4. This occurs as hold down element 2 releases custody of printed product 4 so printed product 4 may be transferred into jaw 6. Folding blade 3 retracts into folding cylinder 1 and the printed product 4 is transported in jaw 6 and released downstream, for example, to a conveyor, fen wheel or further cylinder, etc. as desired during the press operation.

When cylinders 1, 5 are operating in collect mode, printed products 4 are held on folding cylinder 1 by hold down elements 2 for multiple revolutions of folding cylinder 1 during a collect operation before being tucked into jaws 6 of tucking cylinder 5 in a fold-off operation. On each successive revolution of folding cylinder 1, an additional printed product 4 is collected over the previous printed products 4 at each of the hold down elements 2. Thus, a plurality of printed products 4 are collected at each hold down element 2. Once the desired quantity of printed products 4 is collected at a hold down element 2, the amalgam of printed products 4 is folded off to the jaw cylinder 5 in the same manner discussed above. Thus, tucking blade 3 extends out of cylinder 1 and pushes or tucks collected printed products 4 into a jaw 6 thereby forming a cross fold in collected printed products 4. Hold down element 2 simultaneously releases custody of collected printed products 4 which are transported further downstream by jaw cylinder 5.

In accordance with the present invention a paper guide 7 located at the folding interface 33 the outgoing side of the folding cylinder 1 is a compromise between the ideal guide profile for the collect or gathering mode and the ideal profile for the folding mode.

Figure 2:
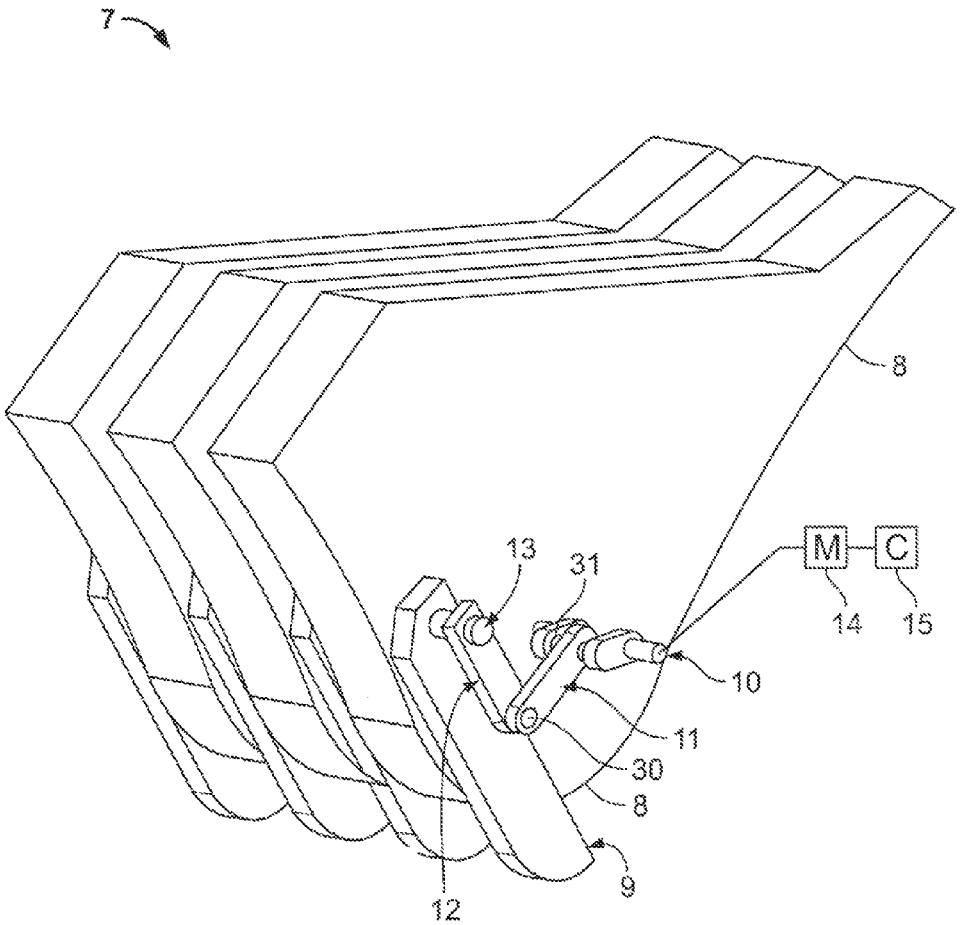
FIG. 2 shows a preferred embodiment of the folding guide shown in FIG. 1 according to the present invention.
Figure 3:
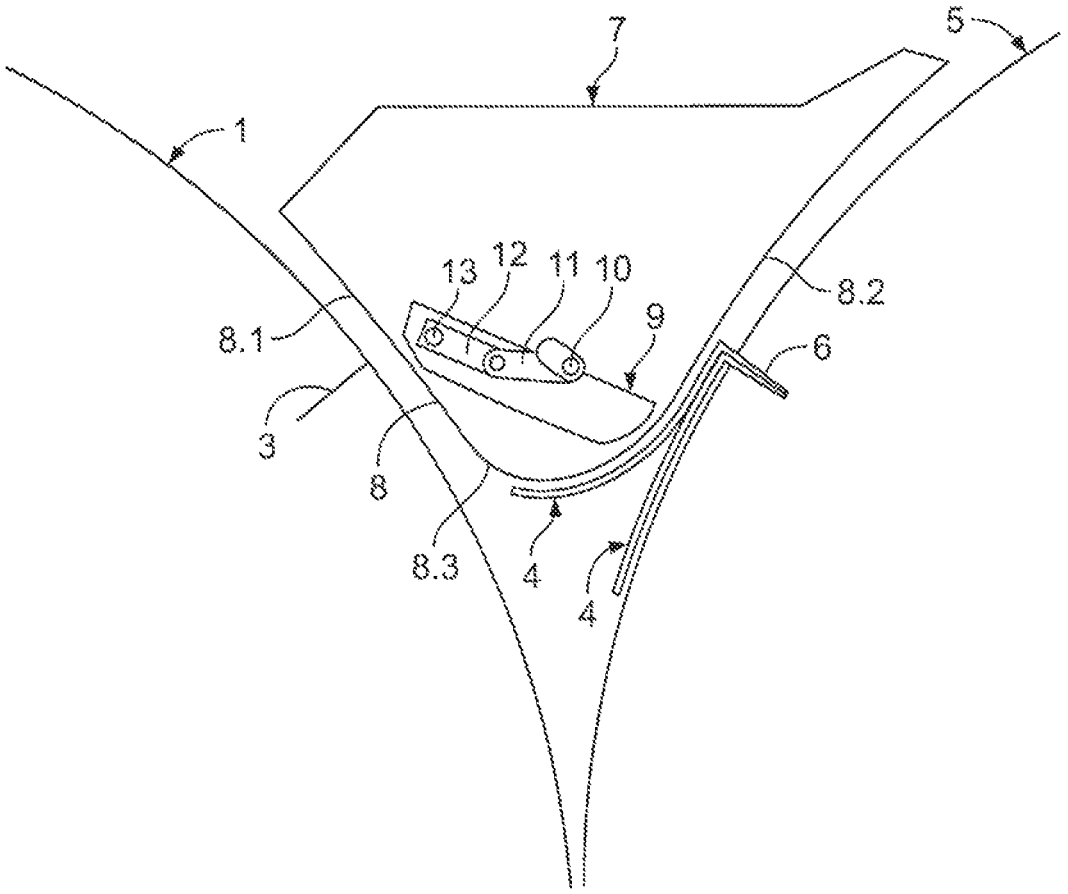
FIG. 3 shows the folding cylinder shown in FIG. 1 as the paper is being folded.

FIG. 2 shows a paper guide 7 in accordance with the present invention. Paper guide 7 includes stationary guide elements 8 which include a profile that favors the straight or fold-off mode without regard to gathering or collecting printed products 4 on subsequent revolutions of folding cylinder 1. In this regard, the profile of the stationary guide elements may include concave profile segments 8.1, 8.2 opposite the cylindrical surface of cylinders 1 and 5 as illustrated in FIG. 3. As also illustrated, the profile of the stationary guide element has a convex segment 8.3 between the concave segments 8.1, 8.2. In accordance with the present invention, reciprocating guide elements 9 are deployed in a position that gives the desired constraint to paper printed products 4 when the printed products 4 are passing by paper guide 7 during the gathering or collect mode operation. Reciprocating guide elements 9 are retracted inside stationary guide elements 8 when a fully formed amalgam of collected paper printed products 4 is being folded off tucking cylinder 1 into jaw cylinder 5.

The reciprocating action of reciprocating guide elements 9 may be provided by an actuator, for example, a crank, mechanism 10 that is equipped with a drive 14 which can have a closed-loop control device 15 in order to follow the rotational speed of cylinders 1, 5. Drive 14 or control device 15 may also be connected to a controller of the folder or printing press. The drive 14 may be further controlled in such a manner that a rotational speed of crank mechanism 10 is variable during a revolution of cylinders 1, 5. The rotational speed and/or phase of the cylinders 1, 5 can be monitored with a position sensor such as an encoder or resolver which is coupled to the axis of one of the cylinders, or to the axis of a shaft, gear, or motor in drive train for the cylinders. Other techniques for detecting the rotational speed and/or phase of the cylinders can also be used, including, for example, optical sensors which detect targets on one or both cylinders 1,5. In any case, the sensed speed or phase is transmitted to the control device 15 or the controller of the folder, or the controller of the printing press, and processed by that controller to move the reciprocating guide elements 9.

Figure 8:
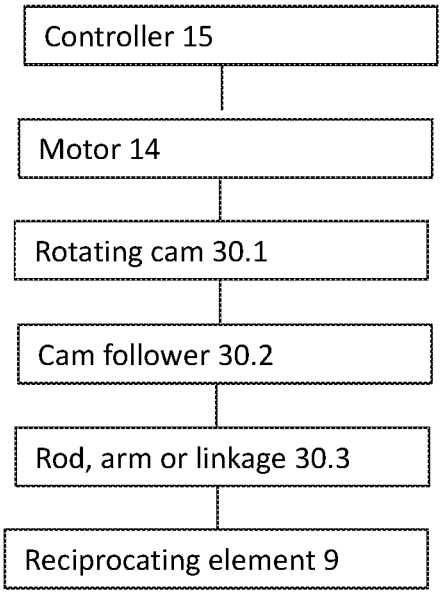
FIG. 8 shows the folding cylinder of FIG. 3, modified to schematically illustrate a cam and cam follower.

Other types of actuators may alternatively be used to create the desired motion of reciprocating guide elements 9, and include for example, a cam and cam follower system. In this regard, for example, a cam follower 30.2 would be connected to the reciprocating element 9 by a rod, arm, or linkage 30.3, and the motion of the cam follower could be controlled by a cam profile of a rotating cam 30.1 as illustrated schematically in FIG. 8.

Referring again to FIG. 2, crank 10 acts on a rotatable link 11 that acts in turn on a fixed link 12 which is attached to a shaft 13. In this regard, fixed link 12 is fixed with respect to shaft 13, and rotatable link 11 is rotatable about pins 30 and 31. When crank 10 rotates the result is an oscillating motion in shaft 13. Reciprocating guides 9 are attached to shaft 13 so guides 9 are positioned alternately between an active paper guiding position during the collect or gathering phase and a refracted position to allow paper guiding to be provided by stationary guides 8 during the folding phase when folding cylinders 1, 5 are operated in a straight, fold off mode or during the folding phase of a collecting or gathering mode operation.

FIG. 3 shows reciprocating guide elements 9 in a retracted position while printed products 4 are folded off into jaw 6. Paper guide elements 8 are guiding paper printed products 4 during this fold-off operation as shown.

Figure 4:
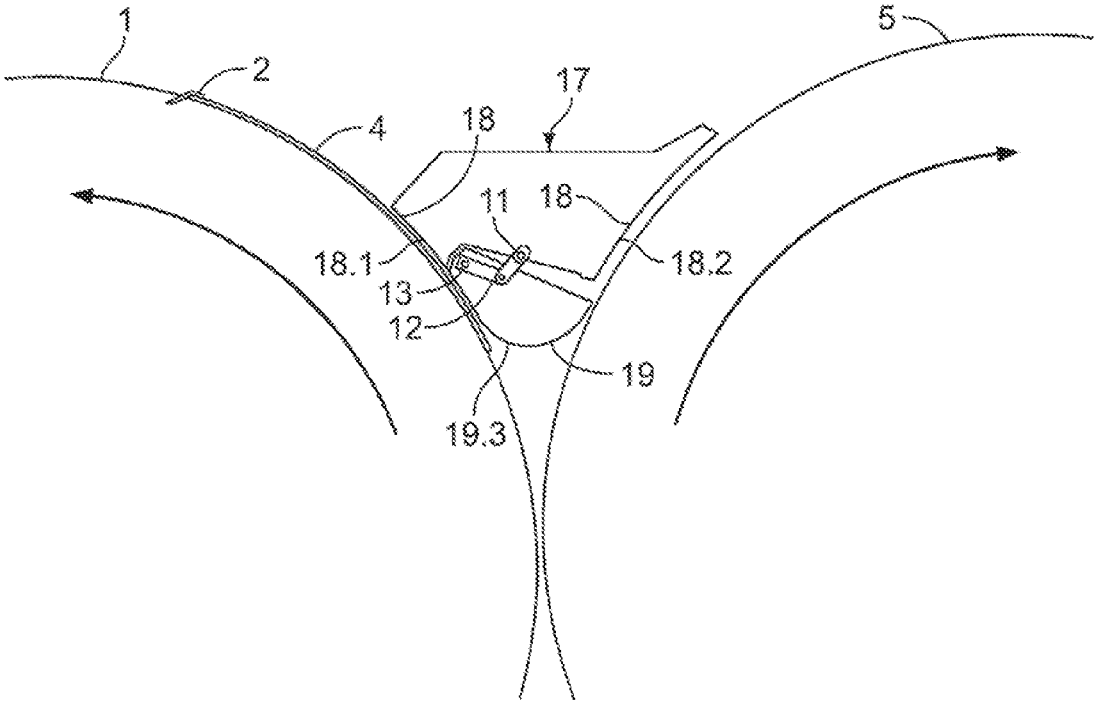
FIGS. 4 and 5 show another preferred embodiment of the folding cylinder and folding guide in accordance with the present invention.
Figure 5:
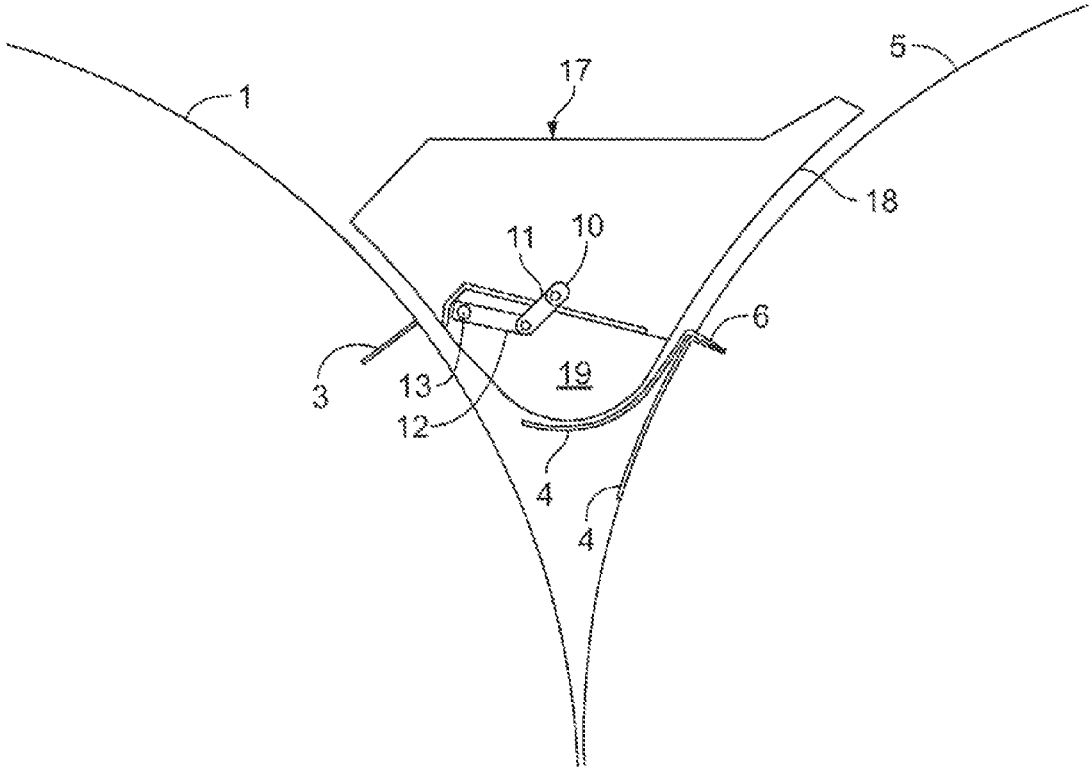
Figure 6:
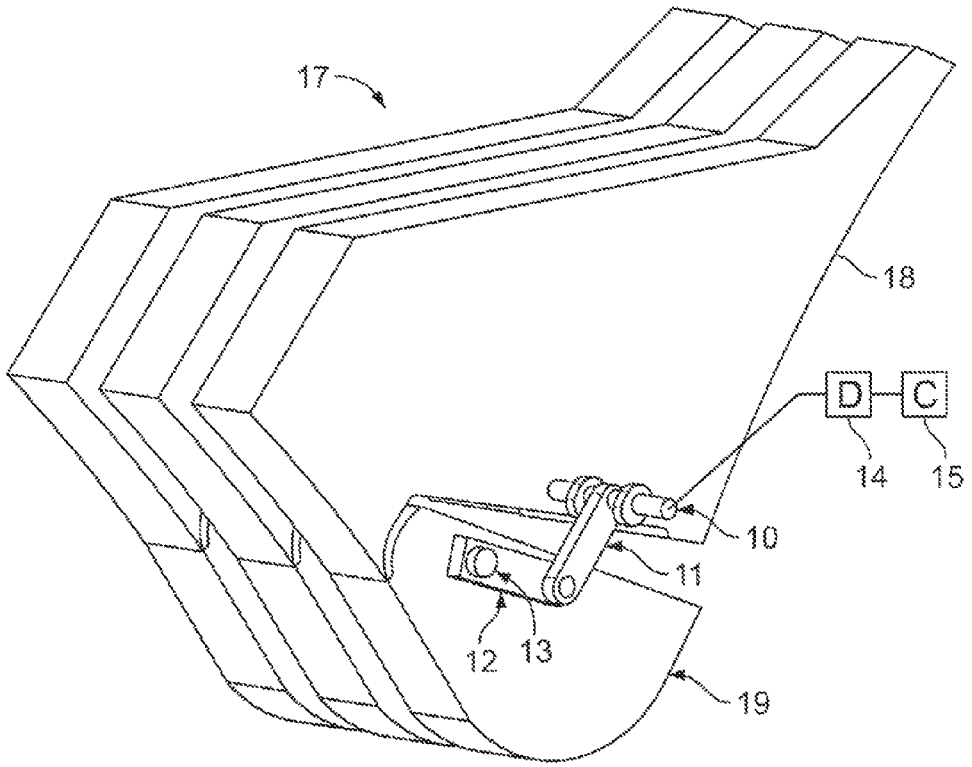
FIG. 6 shows the folding guide of FIGS. 4 and 5 in a gathering position.

FIGS. 4 to 6 show another preferred embodiment of the present invention, with similar components bearing similar reference numerals to FIGS. 1-3. In this embodiment a paper guide 17 is modified to allow reciprocating guides 19 to be positioned in line with static guide elements 18. Static guide elements 18 act as a base for reciprocating guides 19. Movably attached to static elements 18 are reciprocating guide elements 19 which move with respect to static elements 18 into an active position desired for collecting or gathering printed products 4 at hold down elements 2 or a passive position, near static guide elements 18 during the folding operation. Static guide elements 18 have concave segments 18.1 and 18.2. However, in this embodiment, the convex segment 19.3 is provided by the reciprocating guide element 19. Reciprocating guide elements 19 may move via crank 10, shaft 13 and links 11, 12 similar to the manner discussed above with respect to FIGS. 1 to 3. Reciprocating guide elements 19 may also be controlled via a drive or motor 14 and controller as discussed above with regard to FIGS. 1-3, or via a cam and cam follower system.

FIG. 5 shows paper guide 17 in a passive position during folding of printed products 4 into a jaw 6 of jaw cylinder 5. FIGS. 4 and 6 show reciprocating guide elements 19 extended from static guide 18 in an active position during gathering or collect operation while additional printed products 4 are being collected at hold down elements 2 during multiple revolutions of folding cylinder 1. As shown, the extension of reciprocating guide elements 19 permits reciprocating guide element 19 to constrain a trailing edge of printed product 4 as printed product 4 passes between the folding interface of cylinders 1, 5. Thus, printed products 4 are adequately constrained throughout multiple revolutions during collect or gathering mode operations.

FIG. 7 shows a printing press having a folder which includes a paper guide 7 in accordance with the present invention. FIG. 1 shows a printing press 100 including a folder section 120 having a folding devise 20. The printing press 100 may be a perfecting, web offset four color printing press. Printing press 100 may include four printing units 220, 222, 224, 226 each printing on a web 112 with a different color ink, for example, cyan, magenta, yellow and black. Web 112 travels through press 100 in a direction A from printing unit 220 to folder section 120. Each printing unit 220, 222, 224, 226 includes two printing cylinders 30, 32 and two blanket cylinders 34, 36. Each printing cylinder 30, 32 carries a printing plate 31, 33 mounted thereon. Alternatively, the printing cylinders 30, 32 may be etched or imaged directly with a printing image. Each blanket cylinder 34, 36 includes a printing blanket 35, 37 mounted thereon. The printing blankets 35, 37 may be flat blankets mounted into a lockup mechanism or printing blankets 35, 37 may be tubular, gapless, sleeve-shaped blankets. The printing plates 31, 33 transfer images to printing blankets 35, 37 which transfer images to web 12.

The configuration and geometry of printing cylinders 30, 32 and blanket cylinders 34, 36 may be varied as desired and may include, for example, one around printing cylinders (each printing cylinder having one printing plate mounted thereon), two around printing cylinders or three around printing cylinders, the two and three around printing cylinders may carry a single printing plate having multiple images or multiple printing plates, or any combination thereof. Printing plates and blankets 31, 33, 35, 37 may include multiple images across their width. Alternatively, printing units 220, 222, 224, 226 may be digital printing units.

From the printing section, web 112 then enters folder section 120. Folder section 120 includes a triangular shaped former 40 for folding and slitting (if desired) web 112 into ribbons 112*a*, 112*b*. Web 112 may also be combined with other web ribbons 112', 112" for simultaneous folding and slitting. Ribbons 112', 112" may be printed by another printing section or by another printing press. Former 40 folds web 112 in half (if desired) as web 12 runs down a surface of former 40. A slitter 42 on a nose of former 40 may slit web 12 into two ribbons 112*a*, 112*b* or fold a single ribbon in half. Web 112 is slit in half longitudinally, in the direction of travel. The two ribbons 112*a*, 112*b* are combined and continue downstream.

A cross cutter 50 then cuts ribbons into paper printed products 4 which are gripped at a lead edge by hold down, elements 2 of a folding cylinder 1 on an incoming side 34 of the folding cylinder 1. The folding cylinder 1 has pins or hold down elements 2 that selectively articulate to release a printed product 4 for cross-folding, or retain a printed product 4 to collect with other printed products 4. Printed products 4 are then tucked and cross-folded into a jaw 6 of another folding cylinder, for example, jaw cylinder 5. Jaws 6 of jaw cylinder 5 release folded printed products 4 with fold F to conveying tapes 84, 85 for further transport and processing downstream, for example, by a quarter folder 80. Paper guide 7 (or 17), described above, provides constraints on the printed products on the outgoing side of the cylinder 1 at the folding interface 33.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A folding device for folding a sheet comprising a jaw cylinder having a jaw, a folding cylinder having a hold down element and a folding blade, the folding blade movable between an extended position and a retracted position, the folding blade being in the extended position to transfer one or more sheets to the jaw cylinder during a fold off operation, the folding blade being in the retracted position during a collect operation;

a paper guide positioned between the folding cylinder and the jaw cylinder, the paper guide including a static guide element and a reciprocating guide element connected to the static guide element, the reciprocating guide element movable between a retracted position and an extended position; and means, connected to the reciprocating guide element, for placing the reciprocating guide element into the extended position during the collect operation and placing the reciprocating guide element into the retracted position during the fold-off operation.

2. The folding device according to claim 1, wherein the folding cylinder is rotatable about a first axis, the jaw cylinder is rotatable about a second axis, the first axis being parallel to the second axis.

3. The folding device according to claim 2, wherein the jaw cylinder receives the sheet from the folding cylinder at a folding interface between the folding cylinder and the jaw cylinder.

4. The folding device according to claim 3, wherein the static guide element has a first concave surface located adjacent to a circumferential surface of the folding cylinder, and a second concave surface located adjacent to a circumferential surface of the jaw cylinder.

5. The folding device as recited in claim 4, wherein the static guide element includes a convex surface located between the first and second concave surfaces.

6. The folding device according to claim 3, wherein the reciprocating guide element contacts sheets on the folding cylinder during the collect operation.

7. The folding device as recited in claim 4, wherein the reciprocating guide element includes a convex surface located between the first and second concave surfaces of the static guide element.

8. The folding device as recited in claim 1 wherein the means comprises an actuator connected to the reciprocating guide element.

9. The folding device as recited in claim 8, wherein the actuator includes a crank, the crank coupled to the reciprocating element via one or more links.

10. The folding device as recited in claim 9, wherein the crank is rotatably secured to the static guide element, and wherein the folding device further comprising a drive and a controller, the controller controlling the crank via the drive.

11. The folding device as recited in claim 8, wherein the actuator includes a cam and cam follower, the cam follower connected to the reciprocating guide element.

* * * * *